US006568547B1

(12) United States Patent
Kretschmer et al.

(10) Patent No.: US 6,568,547 B1
(45) Date of Patent: May 27, 2003

(54) CRANE, ESPECIALLY A SELF-PROPELLED CRANE

(75) Inventors: Manfred Kretschmer, Hilden (DE); Alfons Weckbecker, Zweibrücken (DE)

(73) Assignee: Atecs Mannesmann AG, Düsseldorf (DE)

( * ) Notice: Subject to any disclaimer, the term of this patent is extended or adjusted under 35 U.S.C. 154(b) by 0 days.

(21) Appl. No.: 09/857,329

(22) PCT Filed: Nov. 29, 1999

(86) PCT No.: PCT/DE99/03880

§ 371 (c)(1),
(2), (4) Date: Jun. 4, 2001

(87) PCT Pub. No.: WO00/34173

PCT Pub. Date: Jun. 15, 2000

(30) Foreign Application Priority Data

Dec. 4, 1998 (DE) ..... 198 57 779

(51) Int. Cl.[7] ..... B66C 23/76
(52) U.S. Cl. ..... 212/196; 212/197
(58) Field of Search ..... 212/195, 196, 212/197, 198, 178

(56) References Cited

U.S. PATENT DOCUMENTS 4,280,627 A * 7/1981 Becker ..... 212/198
4,508,232 A * 4/1985 Lampson ..... 212/178
4,557,390 A * 12/1985 Mick ..... 212/197
4,711,358 A * 12/1987 Konishi ..... 212/178
5,005,714 A * 4/1991 Kroll et al. ..... 212/196
5,035,337 A * 7/1991 Juergens ..... 212/196
5,586,667 A * 12/1996 Landry ..... 212/196

FOREIGN PATENT DOCUMENTS

DE 38 39 975 * 5/1990

* cited by examiner

*Primary Examiner*—Thomas J. Brahan
(74) *Attorney, Agent, or Firm*—Cohen, Pontani, Lieberman & Pavane

(57) ABSTRACT

A crane, especially a self-propelled crane, with a base structure and a revolving superstructure mounted thereon, a boom and a mast being hinged to the superstructure. The tip of the mast is connected on one side via adjustable-length guying to the head of the boom and on the other side via guying to a counterweight. The crane is not provided with a separate superstructure counterweight. The distance between the counterweight and the superstructure of the crane is continuously variable within a fixed range by a frame element, which can move in the vertical place, is mounted on the superstructure, and is connected thereto in a gravity-actuated (nonpositive) manner, The frame element is connected to an apparatus for directing the resulant of the force of the counterweight acting in the direction of gravity and the guying force produced by the suspended load into the superstructure.

14 Claims, 8 Drawing Sheets

CRANE, ESPECIALLY A SELF-PROPELLED CRANE

PRIORITY CLAIM

This is a U.S. national stage of application No. PCT/DE99/03880, filed on Nov. 29, 1999. Priority is claimed on that application and on the following application: Country: Germany, Application No.: 198 57 779.6, Filed: Dec. 04, 1998.

BACKGROUND OF THE INVENTION

The invention pertains to a crane, especially a self-propelled crane with a base structure and a revolving superstructure mounted thereon.

Cranes on which a mast and a superlift counterweight are installed are designed for high load moments. The counterweight moment required for this is produced by the superlift counterweight, which is set up a certain distance away from the crane. Various proposals have been offered for increasing the flexibility of the crane, that is, for increasing a crane's ability to manage different load moments at different work sites with the least possible effort while preserving the mobility and rotatability of the crane.

One proposal for a mobile crane is described in DE 2,814,540 C2. A mobile crane with a revolving superstructure is disclosed. The superstructure is provided with a boom and a mast, which carries a superlift counterweight. Regardless of the load on the crane, this counterweight is supported on the ground in such a way that the superstructure can revolve. An air cushion is used to support the counterweight on the ground; the filling of this cushion can be varied in correspondence with the force measured on the mast. This arrangement also requires a compressor and the associated air lines, which does not make operations any easier. In addition, the distance between the superlift counterweight and the crane cannot be changed.

Another design is described in German Patent No. 195-0373

In this mobile crane, the superlift counterweight is designed in the form of a steerable cart, which is rigidly connected by link joints to the superstructure of the mobile crane. When a load is lifted, the counterweight cart is lifted also and can be swiveled together with the crane. It is a complicated matter to install and use a counterweight cart, and it can be difficult to set up, depending on the terrain. The distance between the counterweight cart and the mobile crane cannot be changed. In addition, the height to which the counterweight cart can be lifted cannot be adjusted as a function of the size of the load to be lifted. If the load were to decrease suddenly, the counterweight cart would not only crash to the ground but could even tip over, depending on how high it had been raised.

A variant of this known design is described in U.S. Pat. No. 4,258,852. The distance between the superlift counterweight and the mobile crane can be changed by a certain amount. For this purpose, the mast connected by variable guying to the superlift counterweight is tilted appropriately, and by replacement of certain lattice mast elements of the lattice mast holding the superlift counterweight a certain distance away from the crane, the distance can be changed by the length of the replaced lattice mast element. The disadvantage of this design is that the distance can be changed only by certain amounts and that rerigging is required to do it. In addition, the counterweight cart or carts must be raised by suspending a load. When two counterweight carts are provided, furthermore, the distance between them must also be adjusted appropriately.

In a prospectus from Manitowoc Engineering Co. (Complete Line Brochure), published in 1992, a mobile crane is presented under the trade name X-Spander, which has a continuously adjustable superlift counterweight. For this purpose, a frame element, which can be supported on the ground by raisable feet mounted at the end, is hinged to the rear of the superstructure. The superlift counterweight can be shifted continuously on this frame element to produce the desired countermoment. A bracket is mounted on the superstructure, the top of which is connected to the head of the boom by adjustable-length guying. The tip of the bracket is also connected by fixed guying to the end of the frame element. The disadvantage of this design is that the overhang is very large because of the fixed frame part, and the room required to accommodate it is not always present at the work site. In addition, the length of the frame element can be changed only by the attachment or removal of segments, which means that rigging is necessary each time. Neither in this proposed design nor in the case of the known crane described previously can the intrinsic weight of the base structure be used to increase the stability of the crane.

SUMMARY OF THE INVENTION

The task of the invention is to provide a crane of the general type in question, especially a mobile crane, by means of which, while preserving the ability to revolve, it is possible to adapt the crane easily to the desired load moments under the given work site conditions without rerigging.

According to the principle of the invention, the distance between the counterweight and the superstructure of the crane can be adjusted continuously in a fixed range by a frame element, which can move in the vertical plane, is mounted on the superstructure, and is connected to the superstructure in a gravity-actuated (nonpositive) manner, this frame element being provided with a means for directing the resultant of the counterweight force acting in the direction of gravity and the guying force produced by the suspended load into the superstructure.

The advantage of this arrangement is that, as a result of the gravity-actuated (nonpositive) connection of the frame element with the superstructure and as a result of the means mounted thereon, the intrinsic weight of the base structure can be used to increase stability. Depending on the direction of the resultant of the counterweight force and the guying force, the means acts either to support it or to counteract it. For example, a situation can be imagined in which, with the counterweight fully extended, the suspended load is not sufficient to raise the counterweight. The raising of the counterweight, however, is the condition which allows the crane to revolve. In this case, the resultant of the guying force and the counterweight force is negative, because the counterweight force acting in the direction of gravity is greater than the guying force produced by the load. In this simplified analysis, the frictional relationships at the deflection points and guyings have been left out of consideration. The means mounted on the frame part is now activated in such a way that, by lifting the frame part vertically, an additional force is produced in the direction of the guying force and opposite the direction of the counterweight force, so that the counterweight is lifted and thus the crane can be revolved in spite of the small suspended load. In the opposite case, the means according to the invention ensures the stability of the crane when the maximum load is suspended, in that an additional force acting in the direction of the counterweight force and opposite the direction of the guying force is produced without the need to set down the counterweight.

The frame element can be installed with freedom of movement in the vertical plane, parallel to the plane of the superstructure; alternatively, it can be designed with freedom to swivel at one end. The swivel axis preferably intersects the rotational axis of the superstructure. The frame element has an axially stationary frame part connected to the superstructure and at least one frame part which can move in the axial direction, parallel to the stationary frame part. The axially movable frame part is preferably designed to telescope with the stationary frame part. The movable frame part can be moved by means of a rack, for example, or by means of a spindle. A piston-cylinder unit, which acts in the axial direction and which is hinged to the stationary frame part, has been found to be especially advantageous.

The means for directing the resultant force has at least one vertically-acting piston-cylinder unit. For space reasons and also to improve the distribution of the forces, one piston-cylinder unit is installed on the right and another on the left of the stationary frame part, one end of each of these units being hinged to the stationary frame part, the other end to the superstructure.

So that the design proposed here can be used not only as a superlift crane but also as a normal crane, the stationary frame part extends beyond the hinge point of the vertically-acting piston-cylinder unit, and this area can be bolted to a load-bearing structure which holds the counterweight. For this purpose, this area of the stationary frame part has a collar-like stiffening member and a rollway for the load-bearing structure holding the counterweight.

To increase the load capacity, additional counterweights can be provided on and locked to the load-bearing structure connected to the movable frame part. For safety reasons, support feet must be provided on the load-bearing structure , the feet extending down to a point close to the ground. To facilitate transport and handling, these support feet can be folded back onto the load-bearing structure. The additional counterweight can preferably be divided into individual stacks, each with its own frame. Each frame can be connected to at least four wheels, so that each individual stack can travel. This arrangement offers the advantage that the additional counterweight can be easily transported to the work site. In addition, the support feet on the load-bearing structure for the counterweight can be omitted, because the wheels fulfill this function. In the superlift operating mode, furthermore, the counterweight, including the additional counterweight, can be moved inward, even if the suspended load is not sufficient to lift them. If, after the counterweights have been moved inward, the counterweight moment is reduced sufficiently, the counterweight can be lifted by the suspended load, and the additional counterweights can be detached from the load-bearing structure.

Operation as a normal crane is still possible with the proposed overall design, in which case the counterweight is pushed inward and takes over the function of the known superstructure counterweight. The projecting length of the stationary frame part is selected so that, after the counterweight has been pushed past the end of the stationary frame part, stability toward the rear is still guaranteed. This offers the advantage that, without rerigging, additional counterweights can be mounted on and bolted to the load-bearing structure holding the counterweight. This can be accomplished by swiveling the crane or, in the case of a mobile crane, by driving it over them. This total counterweight, that is the counterweight plus the additional counterweights, is lifted by suspending an appropriate load, which thus allows the crane to revolve. The load moment can be increased even more by moving the movable frame part farther out. Because the movable frame part can be shifted continuously, the radius can be adjusted to suit the load as work site conditions permit. The minimum radius is determined by the layout of the crane. Various intermediate radii can be obtained by shifting the counterweight toward the rear until the point of static moment at the rear is reached. The maximum radius is determined, first, by the maximum distance by which the movable frame part can be moved and, second, by the overall structure available to absorb the total ballast. In accordance with a first embodiment, the tip of the mast is connected to the counterweight by guying of adjustable length passing over a braced support. With this arrangement, the mast, the length-adjustable guying between the mast and the counterweight, and the guying between the mast and the boom move in correspondence with the displacement of the counterweight. This requires an appropriate control system to coordinate the axial displacement of the counterweight with the swiveling motion of the mast. To reduce the effort required for this, it is proposed as an alternative that the tip of the mast be connected to the counterweight by fixed guying and to the stationary frame part of the frame element by adjustable-length guying passing over a hinged, braced support. In this arrangement, the tip of the braced support is connected by fixed guying to the load-bearing structure of the counterweight. This offers the advantage that, in superlift operating mode, only the fixed guying between the mast and the counterweight is active. The length of the fixed guying between the tip of the mast and the loadbearing bearing structure of the counterweight, which length changes upon displacement of the counterweight, is negligible in comparison to the height of the erected mast and under consideration of the fact that the counterweight shifts by only a few meters in superlift operating mode. When operation is changed back to normal, the fixed guying is removed and only the adjustable-length guying is active. So that both variants can be realized, the lower end of the forked, braced support, which holds a winch for changing the adjustable-length guying in conjunction with a block and pulley, can be hinged as desired-either to the load-bearing structure holding the counterweight or to the stationary frame part of the frame element.

The advantages cited above can be summarized by saying that they produce a significant improvement in operating convenience, in the sense that, under consideration of the space limitations prevailing at the work site, any of the intermediate stages between normal operating mode and superlift operating mode, which provides the greatest countermoment, can be obtained without rerigging.

BRIEF DESCRIPTION OF THE DRAWINGS

An exemplary embodiment of the crane designed according to the invention is explained in greater detail below on the basis of the drawings.

DETAILED DESCRIPTION OF THE PREFERRED EMBODIMENTS

Figure 1:
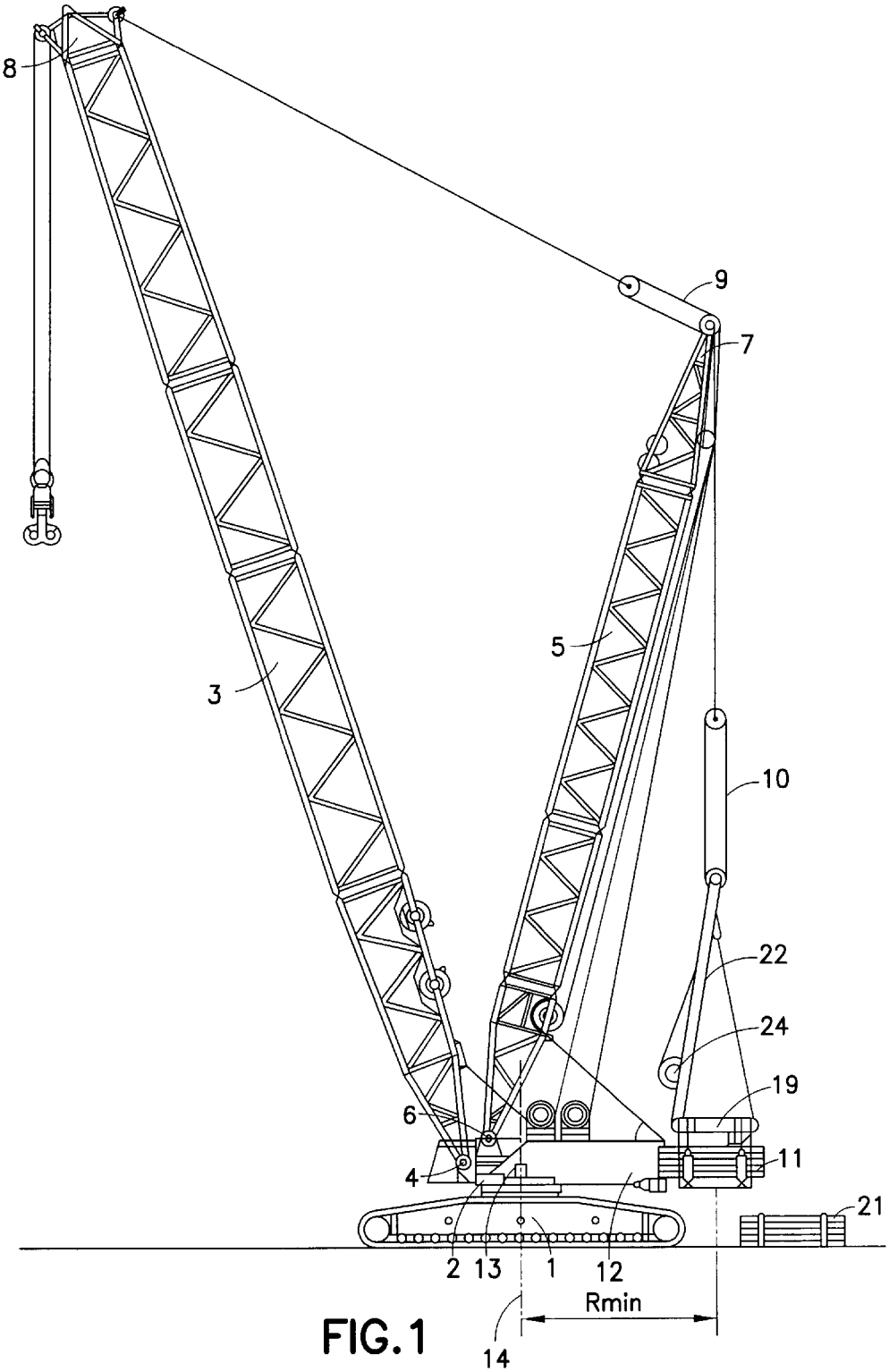
FIG. 1 shows a side view of a crane designed according to the invention in "normal" operating mode.
Figure 2:
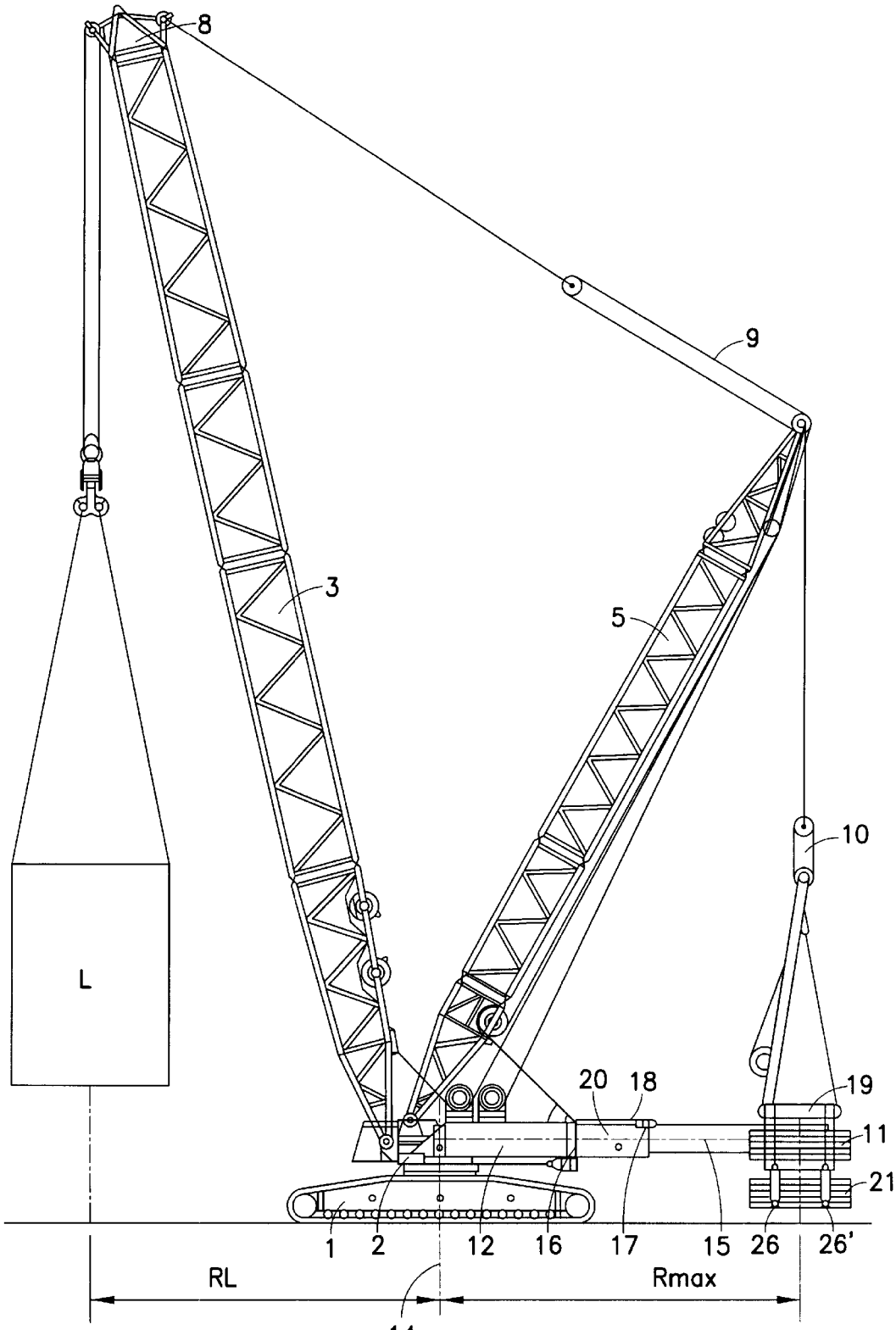
FIG. 2 is similar to FIG. 1, except that it illustrates "superlift" operating mode.
Figure 3:
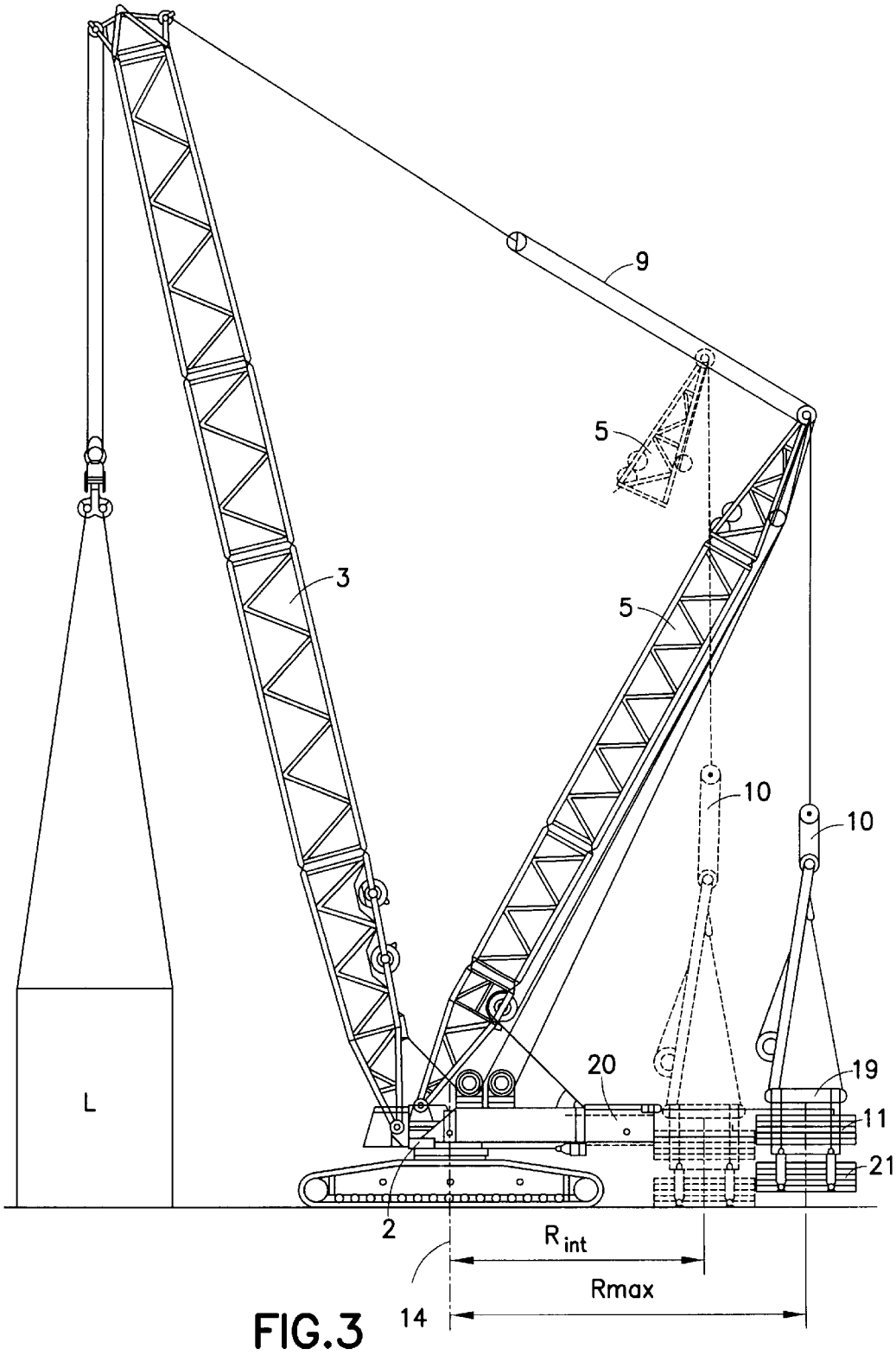
FIG. 3 is similar to FIG. 2, except that it shows the limit areas of superlift operation.
Figure 5A:
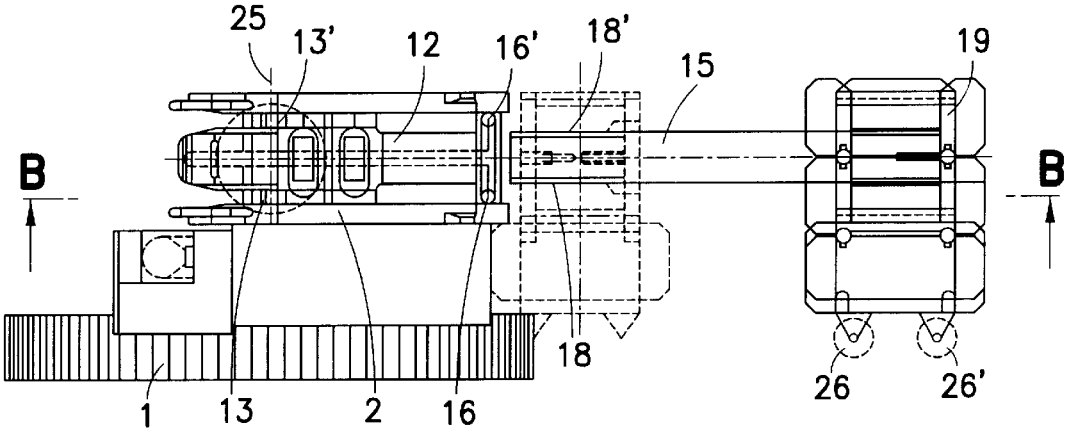
FIG. 5*a* shows a top view of one side without the boom and without the mast.

The crane designed according to the invention as shown in FIGS. 1–3 consists of a base structure, here in the form of a track-type undercarriage 1, and a superstructure 2 mounted thereon with freedom to revolve. At the forward end of the revolving superstructure 2, a boom 3 is attached by a hinged joint 4. A mast 5 is also attached by a hinged joint 6 to this same area. The tip 7 of the mast 5 is connected to the head 8 of the boom 3 by guying 9 of adjustable length. On the other side, the tip 7 of the mast 5 is connected by way of guying 10, also of adjustable length, to a counterweight 11. The guying 10 is connected to the counterweight 11 by way of a forked, braced support 22, 22' (FIG. 5*c*), between the sides of which a winch 24 is also installed to adjust the length of the guying 10. According to the invention, a stationary frame part 12, designed here in the form of a box, is mounted on the revolving superstructure 2 and is connected to the revolving superstructure 2 in a gravity-actuated manner by means of two bearing blocks 13, 13' (FIG. 5*a*), which allow the frame part to swivel. The swivel axis 25 intersects the rotational axis 14 of the revolving superstructure 2. According to the diagram in FIG. 2, an axially movable frame part 15 is mounted in the axially stationary frame part 12 in a telescoping manner. At the rear of the stationary frame part 12, the means which directs the resultant of the counterweight force and the force of the guying into the revolving superstructure 2 is provided. In this exemplary embodiment, the means consists of two piston-cylinder units 16, 16' (FIG. 5*c*), which are located next to the stationary frame part 12, one on the right and one on the left. The stationary frame part 12 extends beyond the hinge point of the piston-cylinder units 16, 16' and has collar-like stiffeners 17, 17' for this area 20 as well as a rollway 18, 18'. This latter feature serves the purpose of allowing the load-bearing structure 19 holding the counterweight 11 to move onto the stationary frame part 12 (see FIG. 1). In the state shown in FIG. 1, the crane is in normal operating mode, in which the counterweight 11, which has been pushed onto the overhanging area 20, takes over the function of a known superstructure counterweight. In this position, the minimum radius Rmin of the center of gravity of the counterweight 11 relative to the rotational axis 14 of the superstructure 2 is obtained. For a crane of a certain design, this value can be, for example, 7 meters.

FIG. 2 shows the same crane as that of FIG. 1, except that here it is in superlift operating mode. In contrast to FIG. 1, an additional counterweight 21 is suspended from the load-bearing structure 19. As can be seen in FIG. 5*d,* the additional counterweight 21 can be divided into individual stacks, and each stack is provided with a frame, which holds the individual weights. The load-bearing structure 19 is equipped with support feet 26-26''', the which has been pushed onto the overhanging area 20, takes over the function of a known superstructure counterweight. In this position, the minimum radius $R_{min}$ of the center of gravity of the counterweight 11 relative to the rotational axis 14 of the superstructure 2 is obtained.. For a crane of a certain design, this value can be, for example, 7 meters.

FIG. 2 shows the same crane as that of FIG. 1, except that here it is in superlift operating mode. In contrast to FIG. 1, an additional counterweight 21 is suspended from the load-bearing structure 19. As can be seen in FIG. 5*d,* the additional counterweight 21 can be divided into individual stacks, and each stack is provided with a frame, which holds the individual weights. The load-bearing structure 19 is equipped with support feet 26-26''', the anchor plates 15 of which can be extended to a point close to the ground. The movable frame part 15 has been extended to the maximum extent, so that the center of gravity of the total counterweight, that is, counterweight 11 plus the additional counterweight 21, is at the maximum radius $R_{max}$. This radius $R_{max}$ can be, for example, 14 meters. So that this total counterweight can be kept suspended, which allows the crane to revolve, a load L is suspended from the boom 3. In the state shown in this FIG. 2, the radius of the load is $R_L=R_{max}$.

FIG. 3 shows the limit region of superlift operation. The solid lines correspond to the maximum possible superlift operation. The broken lines correspond to the minimum possible superlift operation. In this position, an intermediate radius Rint from the center of gravity of the total counterweight to the rotational axis 14 of the superstructure 2 is obtained. After the load L has been set down, the total counterweight can be set down onto the ground also, and the additional counterweight 21 can then be disconnected from the load-bearing structure 19. By moving the movable frame part 15 even farther inward, the state according to the diagram in FIG. 1 is obtained. The corresponding movements of the two guyings 9, 10 and of the mast 5 accompanying the movement of the movable frame part 15 can be seen by comparing the state shown in solid line with the state shown in broken line.

Figure 4:
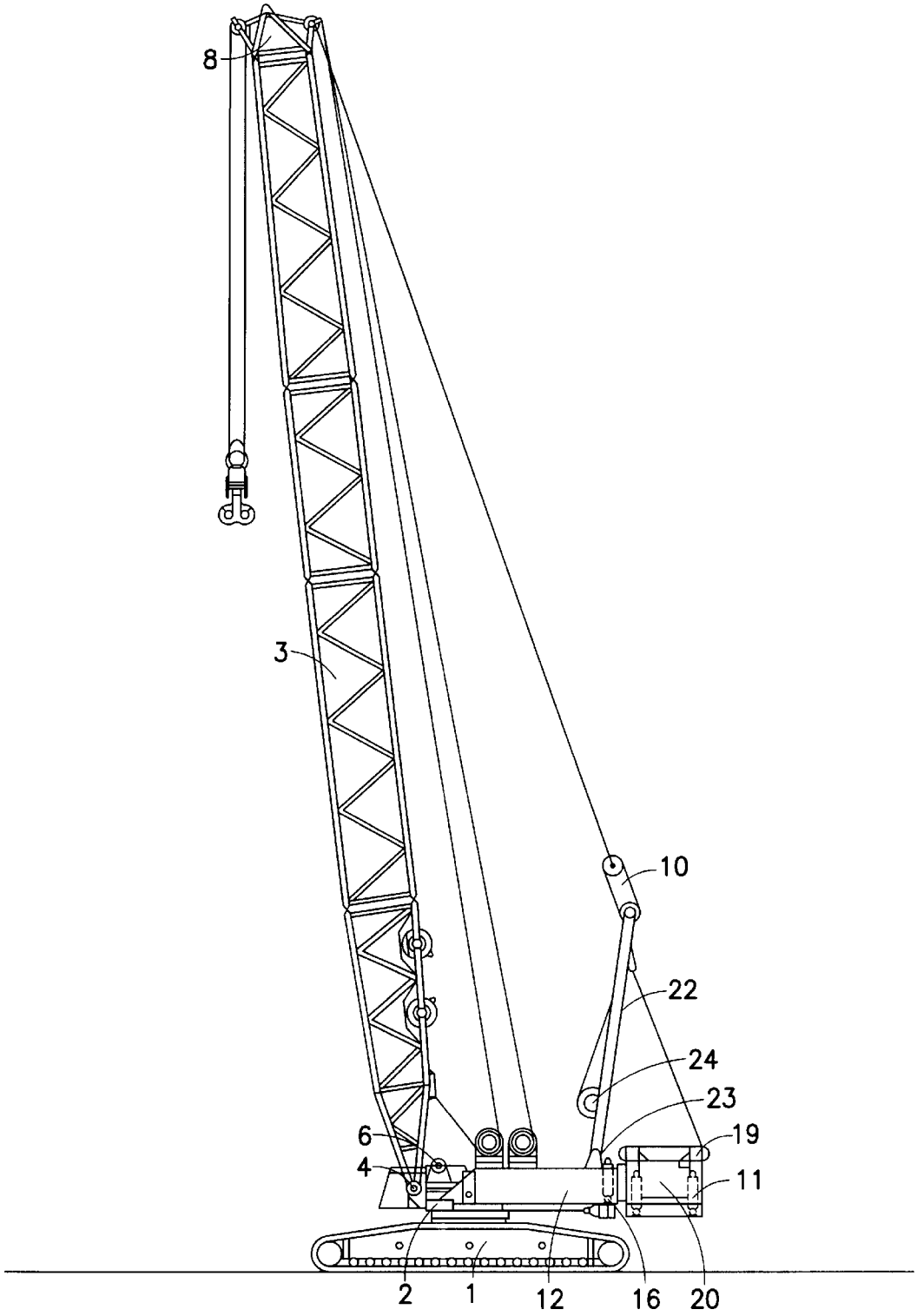
FIG. 4 is similar to FIG. 1, except that it shows a simple crane without a mast.

FIG. 4 shows that the proposed principle of continuous displacement of the counterweight 11 in conjunction with a support means 16, 16' is also advantageous for a simple crane without a mast. In contrast to FIG. 1, the forked, braced support 22, 22' is hinged not to the load-bearing structure 19 for the counterweight 11 but rather to a bearing block 23, 23' mounted on the superstructure 2.

Figure 5B:
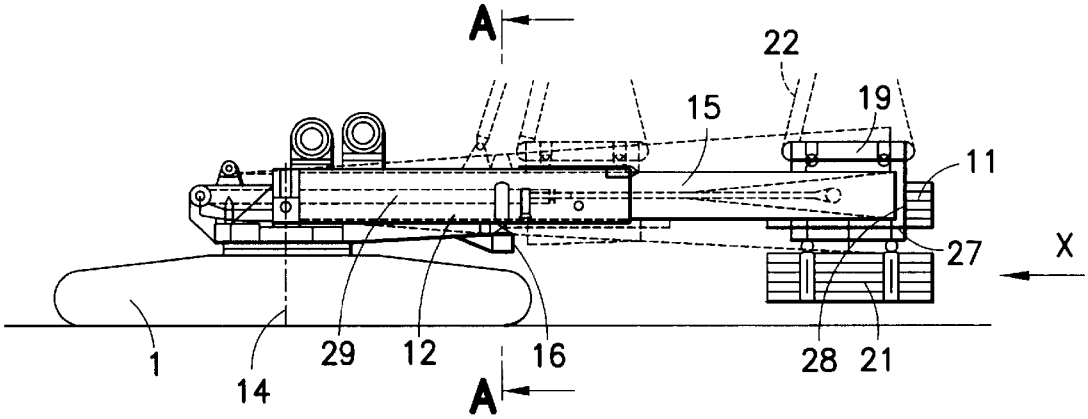
FIG. 5*b* shows a cross section in direction B—B of FIG. 5*a;*
Figure 5D:
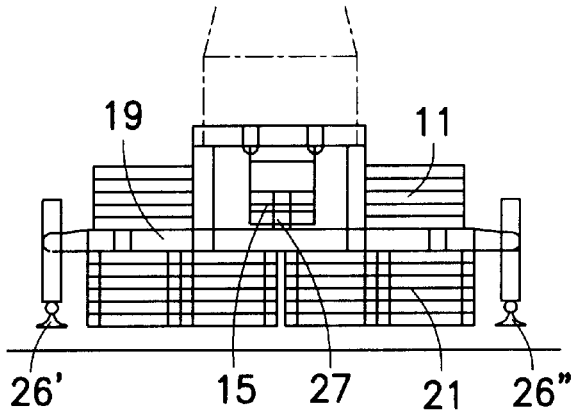
FIG. 5*d* shows a view in direction X of FIG. 5*b;*
Figure 5C:
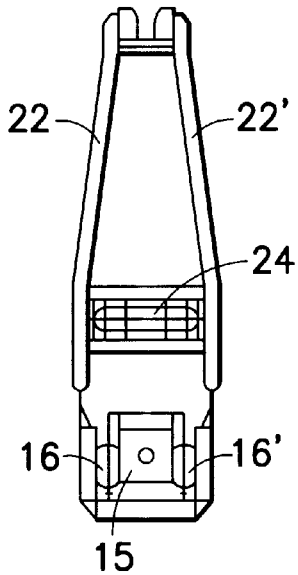
FIG. 5*c* shows a cross section in direction A—A of FIG. 5*b;*

FIG. 5*b* shows; first, the possibility of bolting the load-bearing structure 19 to the axially movable frame part 15. For this purpose, a yoke 27 is mounted on the load-bearing structure 19, and this yoke can be bolted to a bracket 28, mounted in the movable frame part 15. The piston-cylinder unit 29, hinged to the stationary frame part 12, can also be seen in this diagram; this unit is used to move the movable frame part 15 in the axial direction. The broken lines show the maximum possible swiveling movement of the frame part, that is, of the stationary frame part 12 and the movable frame part 15.

Figure 6:
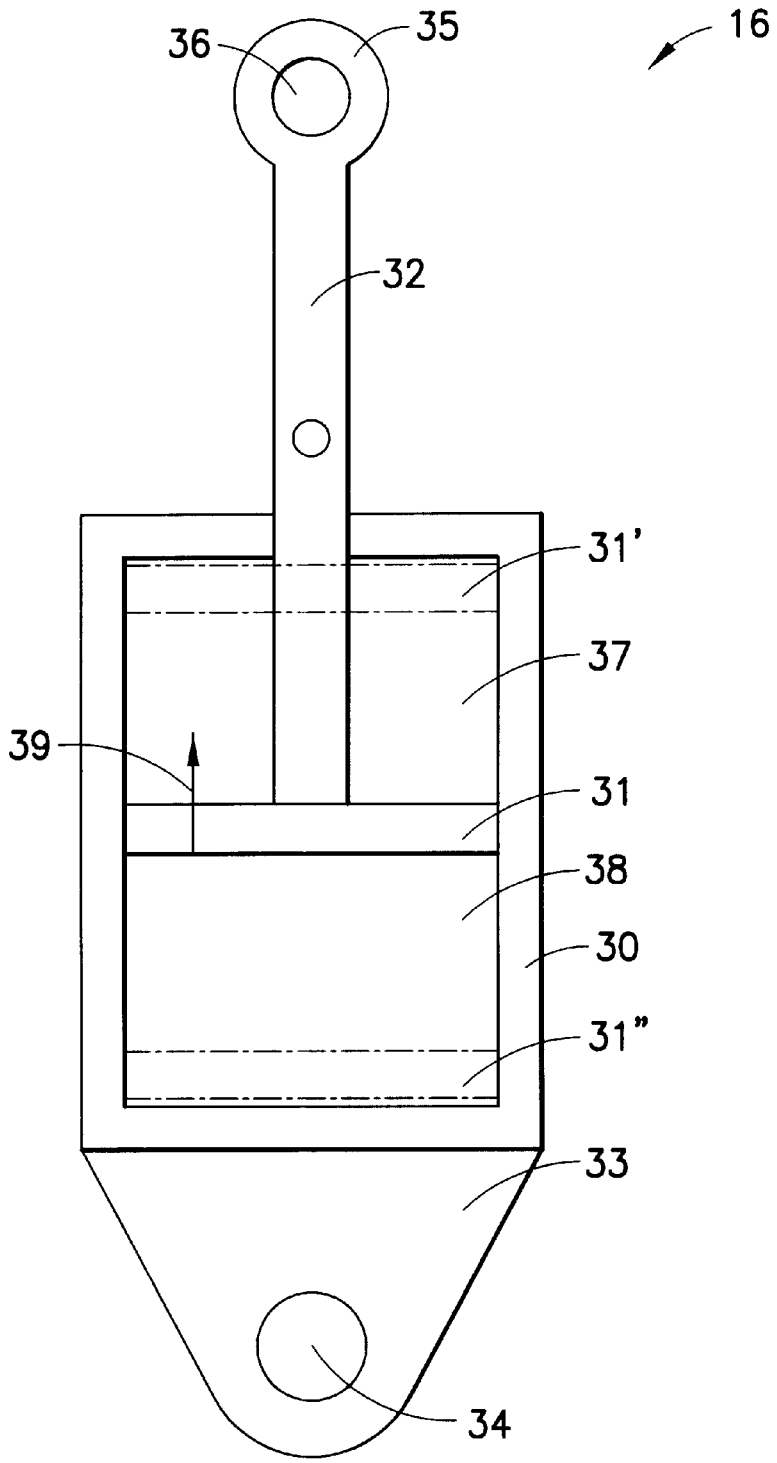
FIG. 6 shows a piston-cylinder unit for shifting the resultant force.

FIG. 6 is a schematic diagram of the piston-cylinder unit 16 for directing the resultant of the counterweight force and the guying force into the superstructure 2. The piston-cylinder unit 16 consists of a cylinder housing 30 and a piston 31 together with a piston rod 32. At the bottom end of the cylinder housing 30, a web 33 with a hole 34 is provided. The hole 34 is the point at which the piston-cylinder unit 16 is hinged to the superstructure 2 (see FIG. 5*b*). The end of the piston rod 32 is designed as an eye 35 with a hole 36. This is hinge point at which the piston-cylinder unit 16 is hinged to the stationary frame part 12 (see FIG. 5*b*). After the counterweight 11 has been set down, the piston 31 assumes the intermediate position shown here. So that the system is kept stable in this position, a preload of, for example, 100 kN is applied to the pre-chamber 37. If, as a function of the suspended load L and the radius of the counterweight 11 or of the additional counterweight 21 to the rotational axis 14 of the superstructure 2, it becomes necessary to lift the total counterweight, an appropriate pressure is applied to the main chamber 38 of the piston-cylinder unit 16. This pressure can be a maximum of, for example, 3,300 kN. The application of the pressure causes the piston 31 to move upward. This is illustrated by a solid arrow 39. As a result of the mechanical connection between the piston rod 32 and the stationary frame part 12, the upward displacement of the piston 31 causes the stationary frame part 12 and thus also the total counterweight connected to it to move upward. The broken lines in FIG. 5b make this clear. In the normal case, the pressure is applied to the main chamber 38 directly by the crane operator, who actuates a manual switch.

In the opposite case, i.e., while the maximum load is suspended, the guying attempts to swivel the stationary frame part 12 upward by way of its connection with the total counterweight and the movable frame part 15. This leads in turn to the upward movement of the piston 31. This movement can be limited by closing the pre-chamber 37 and allowing pressure to build up in it to oppose any further upward movement. So that the piston cylinder unit 16 cannot be overloaded, the pre-chamber 37 is connected to a pressure relief valve (not shown here), which opens whenever the pressure in pre-chamber 37 reaches a certain maximum value. For example, this maximum pressure could be 1,200 kN. When a test load is applied, the piston 31 is shifted into the upper position 31', shown in broken line, limited by a mechanical stop. Conversely, the total counterweight is set down as the piston 31 reaches the lower end position 31" (shown here in broken line).

Figure 7:
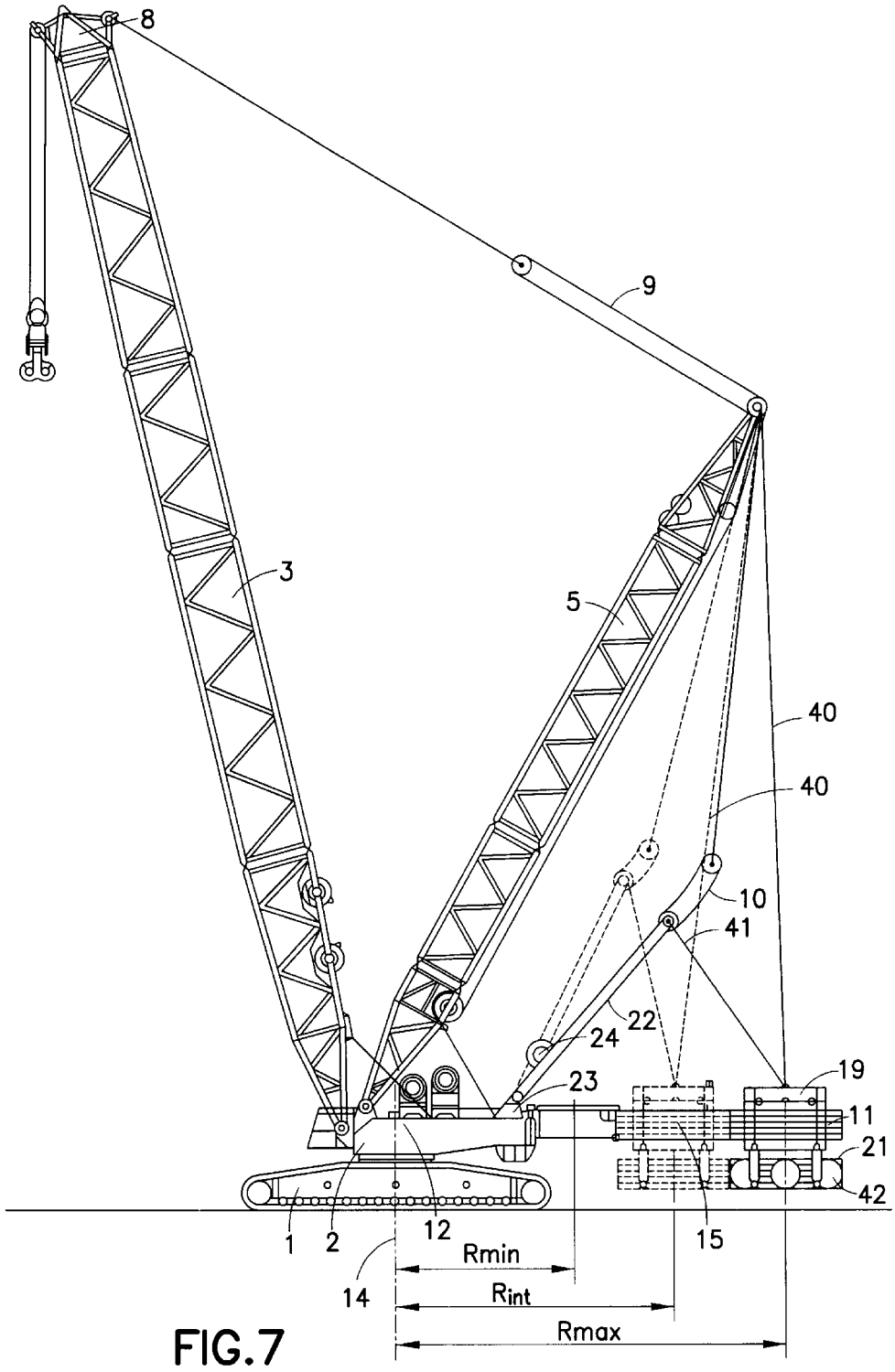
FIG. 7 is similar to FIG. 2, except that it shows a different type of guying.

FIG. 7 shows the same crane as that of FIG. 2 in superlift operating mode, but with a different type of guying. In this embodiment, the tip of the mast 5 is connected via fixed guying 40 to the load-bearing structure 19 of the counterweight 11. In addition, the tip of the mast 5 is connected to the superstructure 2 via adjustable length guying 10 attached to a braced support 22, connected in turn to bearing blocks 23, 23' mounted on the superstructure 2. The tip of the braced support 22 is also connected via fixed guying 41 to the load-bearing structure 19 of the counterweight 11. In the superlift operating mode shown here, only the fixed guying 40 between the tip of the mast 5 and the load-bearing structure 19 of the counterweight 11 is active. The adjustable-length guying 10 is slack. The change in the length of the fixed guying 40 which occurs upon axial displacement of the counterweight 11 from $R_{max}$ to $R_{int}$ is negligible in relationship to the height of the erected mast 5 and under consideration of the shift of only a few meters of the counterweight 11. The broken lines show the counterweight 11 being shifted toward $R_{min}$, where the counterweight 11 becomes a conventional superstructure counterweight. As soon as $R_{int}$ is reached, the fixed guying 40 is detached, and the adjustable-length guying 10 takes over its function. As soon as the counterweight 11 has reached the endpoint $R_{min}$, a situation comparable to that of FIG. 1 is obtained.

FIG. 7 also shows that wheels 42 have been attached to the stacks of the additional counterweight 21. This makes it much easier to transport and handle the additional counterweight 21.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A crane, comprising: a base structure; a revolving superstructure mounted on the base structure; a boom and a mast hinged to the superstructure; guying of adjustable length arranged to connect a tip of the mast on one side to a head of the boom; a counterweight; further guying arranged to connect another side of the mast to the counterweight, without provision of a separate superstructure counterweight; a frame arranged so as to permit a distance between the counterweight and the superstructure to be continuously variable within a fixed range, the frame being movable in a vertical plane, mounted on the superstructure and connected to the superstructure in a gravity-actuated nonpositive manner, the frame including an axially stationary frame part; means connected to the frame for directing a resultant of a counterweight force which acts in a direction of gravity and guying force produced by a suspended load into the superstructure, the means for directing the resultant force including at least one vertically acting piston-cylinder unit hinged to the stationary frame part and hinged to the superstructure, the stationary frame part being connected to the superstructure, the frame further including an axially movable frame part which is movable along a longitudinal axis of the stationary frame part; and a load-bearing structure for the counterweight, the axially stationary frame part being arranged to extend beyond a hinge point of the vertically acting piston-cylinder unit so as to have an overhanging area connectable to the load-bearing structure for the counterweight, an end area of the axially movable frame part is connectable to the load-bearing structure carrying the counterweight.

2. A crane according to claim 1, wherein the movable frame part is configured to telescope with the stationary frame part.

3. A crane according to claim 2, and further comprising a piston cylinder unit hinged to the stationary part so as to act in the axial direction, the movable frame part being connected to the piston-cylinder unit.

4. A crane according to claim 1, wherein a first end area of the axially stationary frame part is mounted so as to be vertically swivelable on the superstructure.

5. A crane according to claim 4, wherein a swivel axis of the axially stationary frame part intersects a rotational axis of the superstructure.

6. A crane according to claim 5, wherein the means for directing the resultant force is located at a second end area of the stationary frame part opposite the first end area, a certain distance away from the swivel axis.

7. A crane according to claim 1, wherein the overhanging area of the stationary frame part has at least one stiffener and a rollway for the load-bearing structure carrying the counterweight.

8. A crane according to claim 1, and further comprising additional counterweights attachable to the load-bearing structure carrying the counterweight and lockable to the load-bearing structure so as to increase bearing load.

9. A crane according to claim 8, wherein the load-bearing structure has fold-out support feet which extend down to a point close to ground.

10. A crane according to claim 8, wherein the additional counterweight is configured to be dividable into individual stacks each with its own frame.

11. A crane according to claim 10, where each frame is connectable to at least four wheels.

12. A crane according to claim 1, and further comprising a hinged, braced support, the tip of the mast being connected by the further guying and the hinged, braced support to the load-bearing structure of the counterweight, both the mast and the adjustable-length guying between the mast and the counterweight on the one side and between the mast and the boom on the other side move concomitantly in correspondence with displacement of the counterweight, a tip of the braced support having a connection, via fixed guying, to the load-bearing structure of the counterweight.

13. A crane according to claim 1, and further comprising a hinged, braced support, and fixed guying arranged to connect the tip of the mast to the counterweight, the further guying and the hinged, braced support being arranged to connect the mast tip to the stationary frame part of the frame element, a tip of the braced support being connected by the fixed guying to the counterweight.

14. A crane according to claim 13, wherein the braced support is forked and has a lower end for holding a winch to change the adjustable-length guying in conjunction with a block and pulley, the lower end being selectively hinged to one of a load-bearing structure holding the counterweight and to the superstructure of the frame element.

* * * * *